United States Patent [19]

Haynes

[11] 4,082,225

[45] Apr. 4, 1978

[54] CONSTANT VOLUME AERATED SHOWERHEAD APPARATUS

[76] Inventor: Kenneth H. Haynes, P.O. Box 12370, Santa Ana, Calif. 92712

[21] Appl. No.: 738,335

[22] Filed: Nov. 5, 1976

[51] Int. Cl.[2] ..... E03C 1/084

[52] U.S. Cl. ..... 239/428.5; 239/499; 239/533.1; 239/571; 239/590.3

[58] Field of Search ..... 239/428.5, 499, 533.1, 239/553.3, 562, 570, 583, 587, 590.3, 590.5, 571

[56] References Cited

U.S. PATENT DOCUMENTS

| | | | |
|---|---|---|---|
| Re. 25,447 | 9/1963 | Hjulian | 239/428.5 |
| 2,164,411 | 7/1939 | Kennedy | 239/499 X |
| 2,680,043 | 6/1954 | Campbell | 239/570 X |
| 3,173,614 | 3/1965 | Aghnides | 239/428.5 |
| 4,000,857 | 1/1977 | Moen | 239/428.5 |

*Primary Examiner*—Bruce H. Stoner, Jr.
*Assistant Examiner*—Andres Kashnikow
*Attorney, Agent, or Firm*—H. Gordon Shields

[57] ABSTRACT

A showerhead is disclosed which provides for a substantially constant volume of water throughout with a varying water pressure source having a metered orifice in response to water pressure acting against a spring and a directional orifice which directs water against a bubble generator plate to aerate the water emanating from the showerhead.

6 Claims, 4 Drawing Figures

CONSTANT VOLUME AERATED SHOWERHEAD APPARATUS

BACKGROUND OF THE INVENTION

1. Field of the Invention:

This invention relates to a showerhead, and, more particularly, to a showerhead which provides a substantially constant output of water through the showerhead without regard to the water pressure of the water supply or source to the showerhead.

2. Description of the Prior Art:

Many different programs have been, and are being, undertaken in an effort to conserve water. It is recognized that water is a commodity of a fixed quantity, most essential for life. With its increasing scarcity, water is a commodity which needs to be conserved. One way which water can be conserved is to limit the amount of water used in taking showers. It appears that showers are preferable to baths for most people. When a person takes a shower, the person is generally rather oblivious to the amount of water consumed.

Typically, a showerhead comprises a conical shaped head connected directly to a water supply pipe, with a perforated disc closing the large end of the conical head. The water from the supply source flows into the head and out through the perforations in the plate. By increasing the pressure of the incoming water to the head, the volume of water through the showerhead correspondingly increases.

In such showerheads, there is no provision for controlling the size of the water droplets or spray emanating from the showerhead. The only variable with such showerhead is in the force of the spray which is directly related to the pressure of the water source. In turn, the volume of water through the showerhead varies according to the pressure of the water source, which is normally eight to twelve gallons per minute with conventional showerheads.

A variation of the showerhead described above is a showerhead with a generally conical head with a central or axial baffle movable in the conical head. The outer periphery of the baffle is generally serrated. By varying the distance between the conical head and the baffle, the size of the particles or spray of the water may be controlled and varied. This structure accordingly allows a user to control the fineness or size of the spray from the showerhead. However, the control of the volume of the water is the same as with the previously described showerhead. That is, by increasing or decreasing the water pressure from the water source, by conventional valving, the volume of the water through the showerhead varies.

In neither of the above described showerheads of the prior art is there any provision for limiting the volume of the water throughput regardless of the pressure of the water source. The user simply varies the volume according to the control of the water valve or valves of the water supply or source.

Another problem inherent with showerheads of the prior art is that they corrode easily and the holes or heads clog due to the mineral contant of the water supply.

SUMMARY OF THE INVENTION

The invention described and claimed herein comprises a showerhead which provides a substantially lower volume of constant throughput of water with respect to the volume of water flowing out of the showerhead without controlling the pressure of the water supply going into the showerhead by controlling a metering slot or opening in response to the pressure of the water acting against a spring. The water is aerated by directing the water from the metered opening through a fixed orifice and against a bubble generator disc.

Among the objects of the present invention are the following:

To produce new and useful showerhead apparatus;

To produce new and useful showerhead apparatus having a constant volume output;

To produce new and useful showerhead apparatus which aerates the water flowing therethrough;

To produce new and useful showerhead apparatus which meters the flow of water through the head without regard to the pressure of the input water;

To provide new and useful showerhead apparatus having a metered output through which a constant volume of water flows in response to the pressure of the input or source water supply acting against a calibrated spring;

To provide new and useful showerhead apparatus and provide a savings in water and energy to heat water for showers;

To provide new and useful showerhead apparatus that is self-cleaning; and

To provide new and useful showerhead apparatus that is durable and long lasting.

DESCRIPTION OF THE PREFERRED EMBODIMENT

Figure 1:
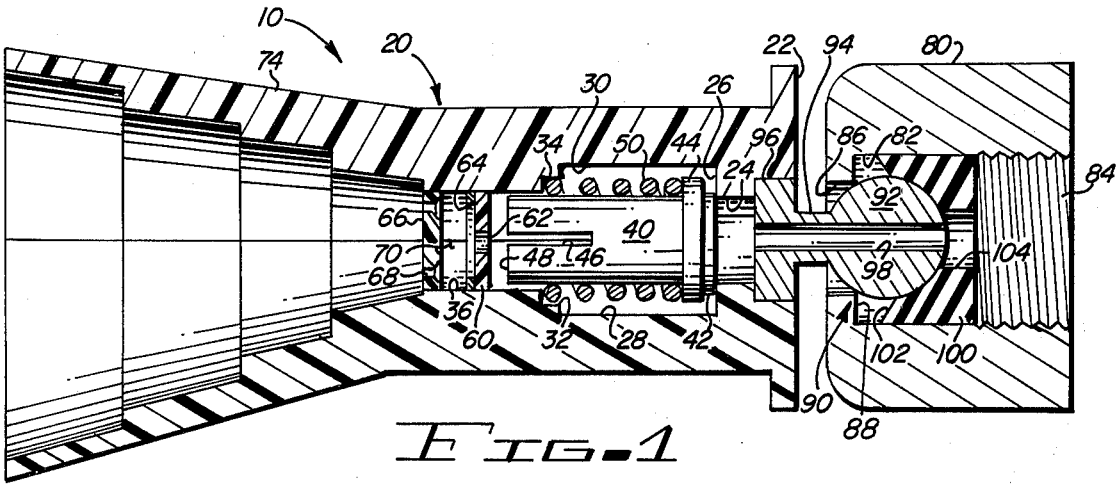
FIG. 1 is a view in partial section of showerhead apparatus embodying the present invention.

FIG. 1 is a view in partial section of showerhead apparatus 10 embodying the present invention. The apparatus includes a housing 20, which may be fabricated of an appropriate plastic material, such as by molding a pair of halves and then, after the appropriate insert elements are in place within the housing, the two halves may be secured together, as by well-known methods, such as by ultrasonic welding. The housing includes a rear face 22 which is preferably substantially perpendicular to the longitudinal axis of the housing. The face 22 is on the upstream side of the housing, or toward the source of the water supply for the showerhead 10.

The housing includes three bores, each of which is coaxially aligned and is disposed centrally of the housing. The first bore is entry bore 24, and is located adjacent the face 22. Adjacent to the entry bore on its downstream side is a central bore 28. The central bore 28 is of a larger diameter than is the entry bore 24. Accordingly, there is a shoulder 26 defined between the entry bore and the central bore. The shoulder 26 is substantially perpendicular to the longidudinal axis of the housing 20. The third primary bore within the housing is the exit bore 36. The exit bore 36, like the entry bore and the central bore, is substantially coaxial with the longitudinal axis of the housing 20.

Between the central bore 28 and the exit bore 36, is a short spring retainer bore 32. A shoulder 30 is defined between the central bore 28 and the spring retainer bore 32, and a shoulder 34 is defined between the spring retainer bore and the exit bore 36. The central bore 28 has the widest diameter of the three primary bores in the housing. The spring retainer bore 32 is of slightly less diameter than the central bore 28, but it is of greater diameter than the exit bore 36.

A cylindrical control sleeve 40 is disposed within the central bore 28 and it extends into the exit bore 36. The control sleeve is a generally hollow cylinder, closed at its upstream portion by a head 42. Head 42 is substantially perpendicular to the longitudinal axis of the control sleeve. Extending outwardly radially of the control sleeve and adjacent the head is a flange 44. The flange 44 extends outwardly from the control sleeve a slight distance, which renders its diameter slightly larger than the diameter of the control sleeve. The flange 44 is spaced apart axially from the head 42 of the control sleeve. The diameter of the head 42 is slightly larger than the diameter of the entry bore 24. Accordingly, the head 42 is disposed against the shoulder 26 in the rest position of the apparatus, when no water is flowing into the apparatus.

The control sleeve 40 includes the plurality of slots which extend axially of the control sleeve remotely from the head 42. The slots 46 extend along the axis of the sleeve from the downstream end 48 of the control sleeve. The length and width of the slots depends on the volume of water desired to flow through the apparatus.

The diameter of the cylindrical control sleeve 40, except for the flange 44, is substantially the same as the diameter of the exit bore 36. Accordingly, when the downstream end 48 of the control sleeve 40 extends into the exit bore 36, the sleeve fits into the bore loosely enough to allow the sleeve to move longitudinally within the bore, but yet tight enough to prevent the loss of a substantial amount of water between the sleeve and the bore.

A compression spring 50 extends circumferentially and axially about the control sleeve between the shoulder 34 of the spring retainer bore 32 and the flange of the control sleeve. The spring provides a force to bias the head 42 of the control sleeve against the shoulder 26 to close the entry bore. The force of the spring 50 is calibrated as desired to control the flow of water through the entry bore 26 and into the central bore 28 about the control sleeve.

A disc 60 is disposed in the exit bore 36 and spaced apart from the downstream end 48 of the control sleeve 40 which extends into the exit bore. The disc 60 includes a central orifice 62 extending through the disc. The disc 60 is disposed substantially perpendicular to the longitudinal axis of the bore 36 and accordingly of the housing 20.

Spaced apart from the disc 60, and at the downstream end of the exit bore 36, is a generator disc 66. The generator disc 66 is also disposed perpendicular to the axis of the exit bore 36 and of the housing 20. The generator disc 66 includes a plurality of holes 68 extending through the disc. The holes 68 are uniform in size and are spaced apart from each other uniformly, and concentrically with respect to the center of the disc and the axis of the bore 36. Each of the holes 68 includes a countersunk portion on the upstream side of the disc 66, facing the disc 60.

While the orifice 62 of the disc 60 is located in the center of the disc, the holes 68 are spaced apart a radial distance from the center of the generator disc 66. Accordingly, water flowing through the orifice 62 of the disc 60 will not flow directly through the hole 68 of the generator disc 66, but will rather impinge on the central portion of the disc 66 and bounce off the disc into the space between the disc 60 and the generator disc 66. The space between the two discs comprises an air gap or chamber 70 in which air drawn into the chamber 70 through the hole 66 mixes with water in the chamber to generate bubbles with the water which then flows back out of the chamber 70 through the holes 68.

Downstream from the generator disc 66 is an exit cone 74 of the housing 20. The exit cone increases in diameter with the axial length of the cone to provide for the dispersion of the water and air mixture emanating or flowing through the hole 68 of the generator disc 66. The exit cone for exit bore 80 could, if desired, be of constant diameter rather than increasing diameter, as shown.

Adjacent the housing 10, and upstream therefrom, is a connector head 80. The connector head 80 includes a bore 82 extending axially with respect to the connector head. At one end, the upstream end, the bore 82 includes internal threads 84. Downstream from the bore, an aperture 86 communicates with the bore and extends towards the face 22 of the housing 20. The diameter of the bore 82 is larger than the diameter of the aperture 86.

A swivel 90 extends between the housing 22 and the connector head 80. The swivel includes a ball or head 92, which is disposed within the bore 82 of the connector, and a flange 96 which is disposed in, and secured to, the housing 20. Between the head or ball 92 and the flange 96 is a neck 94. An axially extending bore 98 extends through the swivel 90.

While the swivel is held securely at one end, that is, at the flange 96, in the housing 20, the ball or head 92 moves relatively freely within the bore 82 and aperture 86. The ball 92 is held in the connector 80 by a sealing gasket 100. The gasket 100 is secured within the bore 82 of the connector 80. The gasket includes a conical seat 102 which is disposed against the head or ball 92. The head 92 is biased against the juncture of the aperture 86 and a shoulder 88, which is defined between the bore 82 and the aperture 86, by the action of the gasket 100. The conical seat is held in a watertight relationship with the head or ball 92 so as to prevent the leakage of water between the seat and the ball. The use of the swivel allows relative motion between the two major portions of the apparatus so that a user of the apparatus may direct the flow of water from the showerhead in a variety of directions.

Extending axially through the gasket 100 is a bore 104 which is substantially larger in diameter than the bore 98 through the swivel 90. Accordingly, regardless of the orientation of the swivel with respect to the connector 80, the bore 98 communicates with the bore 104.

In practice, the connector 80 is secured to a water source or supply by the internal threads 84. The threads are secured against the water supply pipe (not shown) and the pipe in turn biases the gasket 100 against the swivel 90. When the water supply is turned on, water from the supply pipe flows through the bore 104, and into the bore 98 of the swivel. The water in turn flows into the entry bore 24 of the housing and impinges on the head 42 of the control sleeve 40. Depending on the pressure of the water, the control sleeve 40 will be moved against the bias of the spring 50 away from the entry bore 24. Water will accordingly flow from the entry bore 24 into the central bore 28 about the control sleeve 40, and will then flow through the slots 46 into the interior of the control sleeve 40 and from the interior of the control sleeve 40 into the exit bore 36.

The water flowing from the control sleeve 40 into the exit bore 36 will flow through the orifice 62, which is substantially smaller in diameter than the diameter of the bore 36, and against the central portion of the generator disc 66. The force of the water flowing through the orifice 62 and against the disc 66 will bounce back or reflect off the disc 66 into the air gap or chamber 70. When the water bounces off the disc, air is drawn into the air gap or chamber 70 through the holes 68 in the generator disc. Within the air gap or chamber the water is mixed with the air and flows in the mixed condition out of the air gap or chamber and out of the exit bore 36 into the exit cone 74.

With the size of the slots 46 calibrated with respect to the force of the spring 50, the slots and the spring combine to restrict the flow of water from the entry bore 44 into the central bore 28 and out of the central bore into the exit bore. The flow of water accordingly is substantially constant regardless of the pressure of the water flowing through the delivery pipe and into the connector 80, and into the entry bore 24. As the force of the water increases, with increased pressure due to the opening of the water control valve, (not shown) the control sleeve 40 is moved against the bias of the spring 50 which moves the control sleeve farther into the exit bore 36. The movement of the control sleeve 36 into the exit bore decreases the area of the slots 46 which is available to receive water from the central bore 28. Thus the flow of water controlled through the slots by movement of the control sleeve allows only a fixed amount of water to flow through the apparatus.

Unfortunately, most water includes impurities of various types and in varying quantities. These impurities, generally known as "hardness," over a period of time cause deposits to build up particularly in small orifices. Shower heads are commonly affected by these impurities and over a period of time, depending on the hardness of the water, the small orifices or holes through which the water flows in a showerhead may become clogged to the extent that the flow of water is substantially diminished, or, in some showerhead designs, result in the deflection of water from the desired flow pattern. With the apparatus of the present invention there is a self-cleaning action which results from the agitation of the spring 50 and the control sleeve 40 as they move or reciprocate in response to the pressure of the water. There is also a self-cleaning action which results from the agitation of the water within chamber 70 resulting from the flow of the air in one direction through the hole 68 and the flow of water and air in the opposite direction through the hole 68. Accordingly, the apparatus is substantially self-cleaning and the clogging of the holes and orifices or other apertures or gaps (e.g., slots) in the apparatus is not a problem. The self-cleaning aspect of the apparatus provides for a long-lasting useful life before replacement of any parts or cleaning of any parts is necessary.

The aeration of the water which occurs in the chamber 70 by the mixing of the air and water provides the same effect to a user of the shower with less water is larger droplets of water provide in a normal shower, because of the aeration of the water. Less water is used because the smaller droplets of water are mixed with air, and the smaller droplets and air provide the same effect to the user as does the larger droplets without aeration. The mixture of the water and air reduces the weight of the water.

Figure 2:
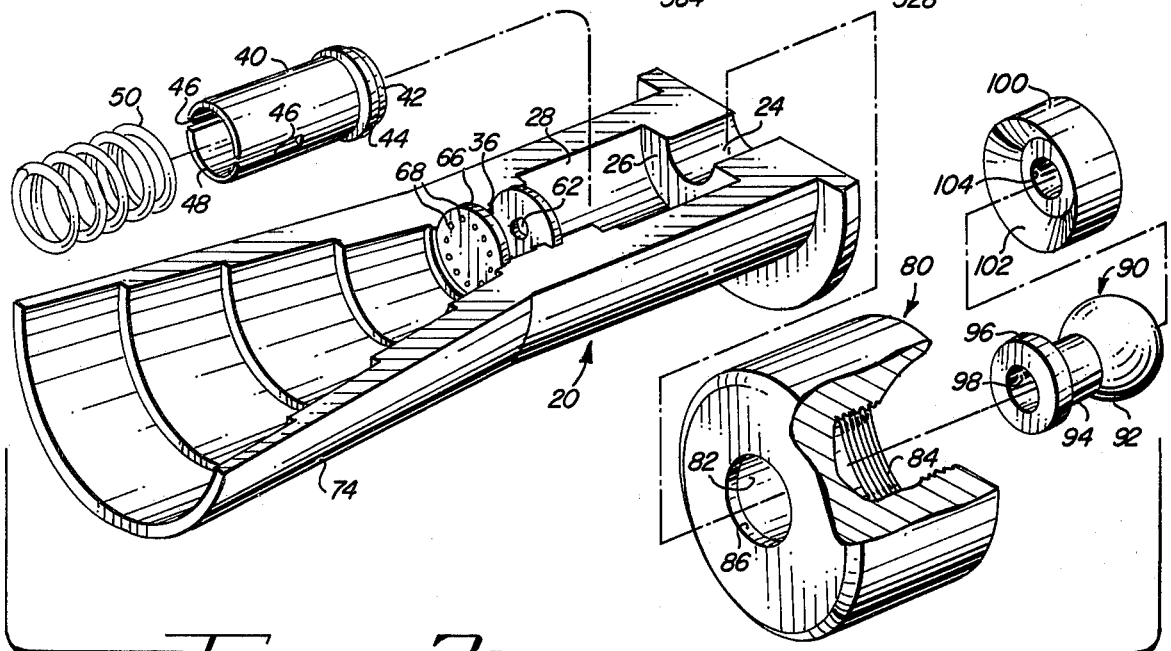
FIG. 2 is an exploded view, in partial section, of the showerhead apparatus of FIG. 1.

FIG. 2 is an exploded view, in partial section, of the showerhead apparatus of FIG. 1. The housing 20 is shown in partial section, and with respect to FIG. 1, appears to be substantially cut in half axially along the longitudinal axis. Preferably, the entire housing 20, including the exit cone 74, is molded out of an appropriate plastic in two pieces, and after the control sleeve 40, spring 50, disc 60, jam ring 64, and generator disc 66 are inserted in the housing, and the flange or stem 96 of the swivel 90 are inserted in their respective places, the two halves of the housing and cone are appropriately secured together, as by ultrasonic welding. The ultrasonic welding secures the two halves of the housing and cone together and also secures the swivel 90 to the housing. As is obvious, before the swivel is secured to the housing, the swivel 90 and gasket 100 must be inserted in the connector 80.

The view comprising FIG. 2 clearly shows the entry bore 24 which receives the flange 96 of the swivel and which also communicates with the central bore 28. The compression spring 50 is disposed about the exterior periphery of the cylindrical control sleeve 40 and the two are then inserted into the central bore 28. The head 42 of the control sleeve, under the bias of the spring 50, seats against the shoulder 26 between the entry bore 24 and the central bore 28. The lower or downstream end 48 of the control sleeve, remote from the head 42, extends into the exit bore 36 to provide communication between the slots 46 and the exit bore. The diameter of the exit bore is slightly larger than the exterior diameter of the control sleeve 40. The spring 50 extends between the shoulder 34 of the spring retainer bore 32 and the flange 44 of the control sleeve 40 to bias the control sleeve against the shoulder 26.

Within the exit bore 36 is disposed in disc 60, with its central orifice 62 communicating between the air gap or chamber 70 and the upstream portion of the exit bore 36. The disc 60 is disposed against the circular jam ring 64, which is intermediate the disc 60 and the generator disc 66. When the two halves of the housing are welded together, the disc 60 is secured to the jam ring 64, and the generator disc 66 is also, by the same welding process, secured in its location within the bore 36 of the housing. Generally, the flange 96 of the swivel 90 is secured in the entry bore 24 by the ultrasonic welding process which secures the two halves of the apparatus, with their various component parts as discussed herein, together.

The flange 96 of the swivel 90 is of a lesser diameter than that of the aperture 86 of the connector 80. Accordingly, the swivel 90 is assembled to the connector 80, with the flange extending to the aperture 86 and the flange 96 is disposed in the bore 24 prior to the assembly of the two halves of the housing. The gasket 100 is inserted into the bore 82 of the connector 80, and the conical seat 102 is disposed against the head 92 of the swivel 90 after the housing, with its component parts therein, secured together. As indicated previously, the bore 104 which extends through the gasket 100 is of a larger diameter than the bore 98 of the swivel to insure that the bore 98 communicates freely with a source of supply water when the connector 80 is secured to a supply pipe by means of the internal threads 84.

Figure 3:
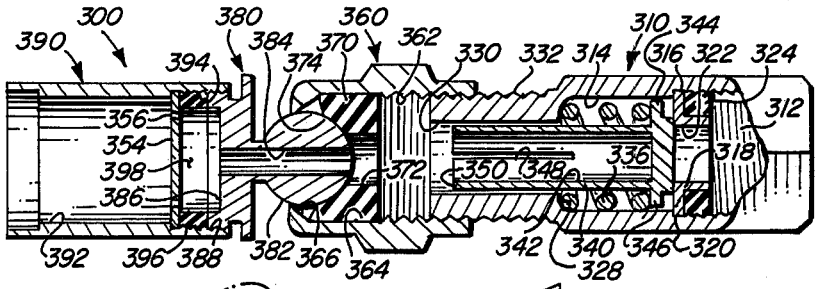
FIG. 3 is a view in partial section of an alternate embodiment of the apparatus of FIG. 1.

FIG. 3 is a view in partial section of an alternate embodiment of the showerhead apparatus of FIGS. 1 and 2. A showerhead apparatus 300 is illustrated in FIG. 3 as being fabricated out of metal, as opposed to the plastic housing of the apparatus 10 of FIGS. 1 and 2. To accommodate the metal apparatus, the arrangement of the component parts is slightly different from, although the net effect of the showerhead apparatus 300 is substantially identical to, the showerhead apparatus 10. Both showerheads comprise apparatus for delivering a constant quantity of liquid, or water, while the inlet pressure of the liquid or water varies. In other words, both apparatus perform the function of saving water, as well as saving the energy to heat shower water, by providing a relatively constant amount of water mixed with air which in turn provides the same effect with respect to the taking of a shower as does a larger quantity of water provided by conventional showerheads without the mixture of the water with air.

Showerhead apparatus 300 includes a metering housing 310 which is connected directly to a water supply pipe by means of internal threads 312. The internal threads 312 fit any standard externally threaded supply pipe in common usage. To facilitate securing the metering housing to the threaded supply pipe, the external configuration of the metering housing 310 is preferably hexagonal. This allows any standard wrench to be conveniently used with the housing. Water flows from the supply pipe into the metering housing 310 through a sleeve 316. The sleeve 316 is disposed at the junction of the internal threads 312 and the entry bore 314. The sleeve includes a cylindrical portion 318 and a radially outwardly extending flange 320. The flange 320 extends radially outwardly from the cylindrical portion and is disposed against a shoulder defined at the juncture of the entry bore 314 and the internal threads 312. A bore 322 extends through the sleeve 316. Disposed about the cylindrical portion 318 and against the flange 316 upstream from or remote from the entry bore 314 is a gasket 324. When the metering housing 310 is secured to the water supply pipe, the end of the supply pipe abuts the gasket 324 to provide a fluid tight connection between the showerhead apparatus 300 and the supply pipe.

Coaxially extending with respect to the metering housing 310 is a central bore 330. The central bore 330 is of a lesser diameter than that of the entry bore 314. A shoulder 328 is defined at the juncture of the entry bore 314 and the central bore 330. Disposed within the entry bore 314 and extending into the central bore 330 is a control or metering sleeve 340. The metering sleeve 340 includes an internal bore 342, a head 344 which closes the bore 342 at the upper or upstream end of the metering sleeve, and an outwardly extending circular flange 346 extending radially outwardly from the head. The metering sleeve 340 is generally cylindrical in configuration, with an external diameter substantially less than the internal diameter of the entry bore 314, but substantially the same external diameter as the internal diameter of the central bore 330. The head 344 is slightly larger in diameter than the bore 318 of the sleeve 316 but is smaller in diameter than the bore 314. A portion of the metering sleeve moves in the central bore in a reasonably fluid tight relationship with the bore, substantially the same as the movable but fluid tight relationship between the control or metering sleeve 40 in the exit bore 36 shown in FIGS. 1 and 2.

A compression spring 336 is disposed within the entry bore 314 and about the cylindrical metering sleeve 340 between the shoulder 328 and the flange 346 on the head 344 of the metering sleeve. The compression spring 336 biases the metering sleeve against the sleeve 316. Since the head 344 of the metering sleeve 340 is larger in diameter than the internal diameter of the bore 322, the bore 322 is effectively closed or blocked by the head 344. Until sufficient water pressure flowing from a supply pipe into the bore 322 and against the head 344 overcomes the bias of the spring 336 to move the head 344 away from the bore 322.

The metering sleeve 340 also includes a plurality of longitudinal slots 348 extending axially through the cylindrical portion of the sleeve remotely from the head 344. The metering sleeve 340 terminates in an open end 350. The metering slots 348 extend axially from the open end 350 toward the head. With the head 344 disposed against the sleeve 316, a substantial portion of the cylindrical metering sleeve is disposed within the central bore 330. In the rest position, with the head 344 disposed against the sleeve 316, a portion of the metering slots 348 extend into the entry bore 314. Once the force or pressure of supply water moves the head of the metering sleeve off or away from the sleeve 316, the water flows about the head and into the entry bore 314. Since the external diameter of the metering sleeve is substantially the same as the internal diameter of the central bore 330, the supply water flows into the central bore through the slots 348. With only a limited portion of the slots 348 communicating with the entry bore 314, the flow of water from the entry bore through the metering sleeve and into the central bore is effectively controlled. As the pressure of the water increases, the metering sleeve is moved against the bias of the spring 336 away from the sleeve 316 and is moved in the downstream direction which decreases the length of the metering slots 348 which communicates with the entry bore 314. The flow of water through the slots into the central bore is accordingly held substantially constant by the calibrated area of the slots 348 available for the flow of water between the entry bore and the central bore. The calibration or control of the water flow is accomplished by the dimensional control of the slots, including the width and the length of the slots and also with respect to the strength of the spring 336. Another consideration is the axial length of the slots 348 with respect to the entry bore 314. Under a minimum pressure of supply water, there is a maximum axial length of metering slots 348 available to the flow of water into the entry bore 314. As the pressure of the supply water increases, there is a decreasing area of metering slots available for the flow of water, and the flow of water from the entry bore into the central bore is accordingly held substantially constant throughout a wide range of water supply pressures available to the showerhead 300.

The metering housing 310 also includes external threads 332 disposed remotely from the internally threaded portion 312. The external threads 332 are disposed on the outside of the central bore 330 at the downstream portion of the housing remote from the upstream portion of the housing and the internal threads 312, and are used to connect the metering housing to an exit nozzle 390. The exit nozzle 390 is secured to the metering housing by means of a connector 360 which is internally threaded as at 362. The internal threads 362 mate with the external threads 332 of the metering housing. Within the connector 360 is a smooth bore 364 downstream from and adjacent to the internal threads 362. At the remote or distal end of the smooth bore 364 remote from the internal threads 362 is an inwardly tapered portion 366. Within the bore 364 and extending between the internally threaded portion 362 and the tapered portion 366 is a gasket 370. The gasket 370 includes an internal bore 372 which communicates with the central bore 330 to allow a flow of water therethrough. A seat 374 is also defined in the gasket 370 remote from the internally threaded portion 362 of the connector 360 and accordingly downstream or remote from the central bore 330. The seat faces or is adjacent to the inwardly tapered portion 366.

The exit nozzle 390 is connected to a swivel head 380 which in turn is secured to the metering housing 310 by the connector 360. The swivel head 380 includes a ball 382 which is received by the seat 374 of the gasket 370 and is held in a watertight engagement or sealing engagement between the tapered portion 366 of the connector and the seat 374 of the gasket. When the connector 360 is secured to the metering housing 310, the metering housing 310 is disposed against the gasket 370 to provide a sealing engagement between the gasket and the metering housing 310, to allow for the flow of water directly from the central bore 330 into the bore 372 of the gasket 370.

The swivel head 380 also includes a bore 384 which is substantially smaller in diameter than the bore 372 of the gasket 370. This allows the flow of water from the central bore 330 of the metering housing 310 into the bore 372 and from the bore 372 into the bore 384 regardless of the position of the ball 382 with respect to the connector 360 and accordingly with respect to the bore 372.

The swivel head 380 includes a counterbored portion 386 remote from the ball 382. The bore 384 terminates at the counterbored portion 386. The end of the swivel head is thus defined by an annular rim (see FIG. 4) adjacent exterior threads 388. On the exterior periphery of the swivel head 380 remote from the ball 382 and in the general area of the counterbore 386 is an externally threaded portion 388. The external threads 388 mate with internal threads 394 on the interior of the exit nozzle 390 to secure the swivel head and the exit nozzle together.

The exit nozzle 390 includes an internal exit bore 392 which, as illustrated herein, is of a substantially uniform internal diameter and is cylindrical in configuration. A generator disc 354 is disposed in the bore 392 adjacent the internally threaded portion 394 of the exit nozzle. The generator disc 354 is disposed against an internal shoulder between the threads 394 and the bore 392. An annular spacer gasket 396 is inserted against the generator disc 354 to hold the generator disc within the exit nozzle and to provide a fluid tight engagement between the swivel head 380 and the exit nozzle 390. The spacer gasket 396 also provides and helps define a chamber 398 between the generator disc 354 and the swivel head 380. The chamber 398 is accordingly defined by the counterbore 386, the generator disc 354, and the interior of the annular spacer gasket 396. The bore 384 opens directly into, or communicates directly with, the chamber 398. At the counterbore 386, the bore 384 comprises an orifice, similar to the hole or orifice 62 of FIGS. 1 and 2, from the bore towards the center of the disc 354.

The generator disc 354 includes a plurality of apertures or small holes 356 which extend through the generator disc adjacent the outer periphery of the disc. The apertures or holes are preferably disposed in a regular pattern and are generally concentric with the center of the disc 354, substantially identical to the plurality of holes 68 which extend through the generator disc 66 of the showerhead illustrated in FIGS. 1 and 2. As illustrated, the holes are arranged in a circle, with the centers of the holes on the circle a fixed radial distance from the center of the disc. This is substantially the same arrangement as shown in FIGS. 1 and 2 with disc 66 and holes 68. With the flow of water metered to central bore 330 and accordingly through the bore 384 of the swivel head into the chamber 398, the water flows through the bore 384 and impinges on the central portion of the generator disc 354. The holes 356 are spaced apart radially away from the center of the disc and accordingly are not subject to the direct flow of water from the bore 384.

The water bounces off the central portion of the disc 354 and into the chamber 398. The movement of the water in the chamber 398 causes air to be pulled into the chamber through the holes 356, and the air and water mix together in the chamber 398 before flowing outwardly through the holes 356. The movement and mixing of the air and water in the chamber 398 results in the aeration of the water droplets and the aerated water droplets flow out of the exit nozzle 390 through the holes 356 and the exit bore 392. The spray of water thus flowing outwardly from the showerhead apparatus is a relatively constant flow of water mixed with air throughout a wide range of inlet or supply water pressures. That is, generally without regard to the pressure of the water as supplied to the showerhead apparatus 300, there is a substantially constant volume of water flowing out of the showerhead apparatus. The relatively constant volume of water is mixed with air and a substantially lesser amount of water has the same effect with respect to the taking of a shower as does a larger volume of water that is not mixed with air.

Figure 4:
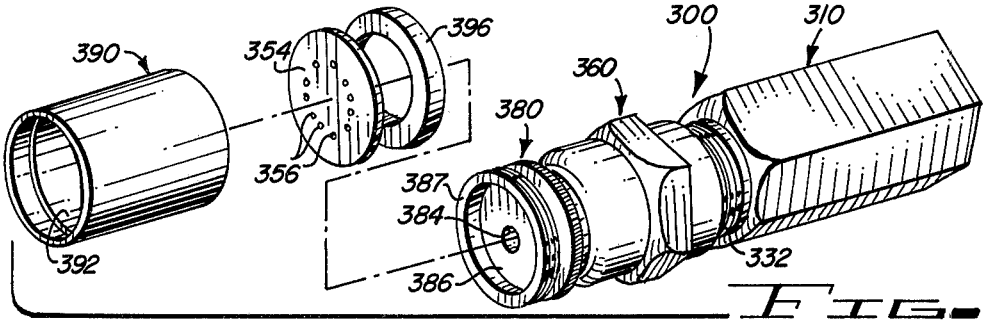
FIG. 4 is a perspective view, partially exploded, of the apparatus of FIG. 3.

FIG. 4 is a perspective view of the apparatus of FIG. 3 with parts broken away. The showerhead apparatus 300 is shown with its various components generally assembled. The metering housing 310 is shown assembled with its internal elements or components disposed therein and with the connector 360 secured to the metering housing. Internal threads in the connector 300 mate with external threads 332 of the metering housing to secure the two portions together.

The swivel head 380 is secured to the connector 360 remote from the metering housing 310. The exit nozzle 390 is shown with its two primary components removed therefrom and disassembled from the swivel head 380. The bore 384 of the swivel head is shown communicating directly with the counterbore 386. The generator disc 354, with its plurality of spaced apart holes 356, is shown separated from the exit nozzle 390, and the spacer gasket 396 is shown adjacent the generator disc 354. The spacer gasket 396, when the generator disc 354 is inserted into the exit nozzle 390 adjacent the bore 392 of the nozzle, comprises a spacer, as well as a gasket, to space apart the disc 354 from an end or rim 387 of the swivel head 380. Thus the water flowing through the bore 384 is directed against the center portion of the disc 354 which is spaced apart from the end of the bore 384 at the counterbore 386.

The metal showerhead apparatus 300 includes substantially the same features of the plastic showerhead apparatus 10 illustrated in FIGS. 1 and 2. The metering is accomplished in substantilly the same manner, but the arrangement of the parts is slightly different to accommodate the differences between the two types of heads. The functioning of the generator discs of both showerhead apparatus is substantially identical and both include the feature of self cleaning with respect to the clogging of the holes or apertures by insoluble minerals in the water, and the like.

The use of the showerhead apparatus provides substantial savings in both energy required to heat water and the water used in the taking of showers. In a typical situation, the apparatus described herein provides a relatively constant flow of two gallons per minute as opposed to the six to ten gallons per minute usually consumed in the taking of a shower. The output of two gallons per minute is relatively constant without regard to the water pressure of the supply water. Obviously, a certain amount of pressure of the supply water is required to initially overcome the bias of the compression spring which biases the control or metering sleeves in the apparatus.

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted for specific environments and operative requirements without departing from those principles. The appended claims are intended to cover and embrace any and all such modifications, within the limits only of the true spirit and scope of the invention. This specification and the appended claims have been prepared in accordance with the applicable patent laws and rules promulgated under the authority thereof.

What is claimed is:

1. Apparatus for providing a substantially constant output of aerated water, comprising, in combination:

housing means for receiving a flow of water;

bore means including a first portion and a second portion in the housing means through which the water flows;

a metering sleeve disposed in the bore means and movable in the bore means in response to the flow of water into the housing means for controlling the flow of water through the bore means, including an internal bore having an open end disposed in the second portion of the bore means, a head defining a closed end of the internal bore remote from the open end disposed in the first portion of the bore means, and slot means for providing for the flow of water from the first portion of the bore means into the internal bore and into the second portion of the bore means;

a chamber for receiving the flow of water from the bore means;

an orifice through which the water flows from the bore means into the chamber;

a disc spaced apart from the orifice and including a central portion against which the water flows from the orifice; and a plurality of holes extending through the disc adjacent the center portion through which air flows into the chamber for aerating the water and through which the aerated water flows out of the chamber.

2. The apparatus of claim 1 in which the first portion of the bore means has a diameter greater than the diameter of the second portion of the bore means, and the outside diameter of the metering sleeve is substantially the same as the diameter of the second portion of the bore means.

3. The apparatus of claim 2 in which the bore means includes a third portion extending through the housing means and communicating with the first portion of the bore means and the head of the metering sleeve is disposed within the first portion of the bore means and against and closing the third portion of the bore means.

4. The apparatus of claim 3 in which the housing means includes means for biasing the head of the metering sleeve against the third portion of the bore means and the metering sleeve moves in response to the flow of water from the third portion of the bore means against the head of the metering sleeve.

5. The apparatus of claim 4 in which the housing means includes an exit bore through which the aerated water flows out of the apparatus.

6. The apparatus of claim 5 in which the housing means further includes swivel means for directional flow of the aerated water out of the exit bore.

* * * * *